United States Patent [19]

Halfen

[11] 4,171,094

[45] Oct. 16, 1979

[54] APPARATUS FOR MAKING USE OF WATER FOR HEALTH CARE

[76] Inventor: Norbert Halfen, Wingertsbergstr. 23, 5450 Neuwied 23, Fed. Rep. of Germany

[21] Appl. No.: 847,657

[22] Filed: Nov. 1, 1977

[30] Foreign Application Priority Data

Nov. 4, 1976 [DE] Fed. Rep. of Germany ..... 2650517
Mar. 23, 1977 [DE] Fed. Rep. of Germany ..... 2712624

[51] Int. Cl.[2] ..... B05B 1/20

[52] U.S. Cl. ..... 239/186; 239/282; 239/588

[58] Field of Search ..... 239/184, 186, 187, 225, 239/587, 588, 280.5, 281, 282, 283; 4/145, 152, 158

[56] References Cited

U.S. PATENT DOCUMENTS

| | | | |
|---|---|---|---|
| 1,982,509 | 11/1934 | Frank | 4/145 X |
| 2,060,100 | 11/1936 | Michelson | 239/282 X |
| 2,971,699 | 2/1961 | Reiss | 239/186 X |
| 3,592,387 | 7/1971 | Pilott | 239/186 |
| 3,971,074 | 7/1976 | Yxfeldt | 4/145 |

FOREIGN PATENT DOCUMENTS

| | | | |
|---|---|---|---|
| 361525 | 11/1931 | United Kingdom | 239/186 |

*Primary Examiner*—John J. Love
*Attorney, Agent, or Firm*—Cushman, Darby & Cushman

[57] ABSTRACT

This invention relates to apparatus for making use of water for health care. A guide strut is arranged for vertical attachment to a support means which may be a wall or a stand device and a slider cooperates with this guide strut; a spray tube is connected to the slider and a connector is provided on the spray tube to accept a flexible water-supply pipe. There is a drive element associated with the guide strut which is arranged to effect the up and down movement of the spray tube and is fitted with a drive means and a switch; the switch serves to reverse the direction of rotation of the drive means and is arranged to be actuated by two spaced engagement members.

3 Claims, 7 Drawing Figures

APPARATUS FOR MAKING USE OF WATER FOR HEALTH CARE

BACKGROUND OF THE INVENTION

The present invention relates to apparatus for making use of water for health care.

Among the natural means of stimulating human blood circulation and of increasing physical resistance is, inter alia, the use of water. What this involves is applying water to the body in a varying pattern both by applying the water intermittently to individual parts of the body and thereby performing massage, and at the same time varying the temperature of the water.

To use water in this way an assistant is generally required such as are available in baths and spas for example. It would however be useful if water could be used in this way without outside help and above all if this were possible in the home.

However, ordinary domestic showers which have hand spray-nozzles fail to meet the requirements which then exist. Firstly the spray heads are designed more for sprinkling than for massaging and are therefore unsuitable and secondly hardly any user would be capable of using a hand spray-nozzle in such a way that water was applied systematically and effectively to all parts of the body. There is also the slight risk that water will get outside the shower when this is done.

In addition to showers of this nature there are also ones in which a number of nozzles is arranged along the walls. Leaving aside the facts that it is very expensive to equip a shower in this way ab initio and that it is virtually impossible so to fit it up afterwards, intermittent massage of individual parts of the body is not possible in this way.

It is here that the invention finds its place. It is an object of the invention to provide an apparatus for using water for health care which enables a user to apply water intermittently to individual parts of the body without outside help and to apply massage in so doing, and at the same time to vary the temperature of the water. The intention is also that the apparatus should be suitable for fitting to existing shower installations.

SUMMARY OF THE INVENTION

This and other objects are achieved in accordance with the proposal of the invention by an apparatus consisting of a guide strut to be attached vertically to a wall, a stand or the like, a slider which cooperates with the guide strut, a spray tube or the like connected to the slider which has a connector for a flexible water supply pipe, a drive element, preferably arranged inside the guide strut, which is responsibe for the up and down movement of the spray tube and which has a drive means and a switch which serves to reverse the direction of rotation of the drive means and which can be operated by two spaced engagement members.

The apparatus according to the invention is particularly easy to fit to a wall, especially in an existing shower, but can also be used in the open, etc., on a stand of its own. The slider is usefully fitted to the guide strut in such a way as to be secure against rotation. The spray tube may be of various shapes, e.g., U-shaped or straight and it is advantageous for it approximately to match the width of the human body. Water is fed in through a flexible water-supply pipe as in the case of a conventional hand spray-nozzle. Thus, in the simplest case, the water supply pipe may be detached from a hand spray-nozzle and connected, when required, to the apparatus according to the invention.

Widely differing types of drive are possible (e.g., hydraulic) but preferably it is electric and designed for low voltage. The switch and the actuators provide a continual and automatic switched change-over and thus for a continuous up and down movement by the spray tube.

In this way, the apparatus according to the invention allows water to be used or water massage to be given in the manner desirable for health care, i.e., provides for water to be applied intermittently to individual parts of the body with the additional possibility of varying the temperature of the water at the same time, without an assistant being required for this purpose. The water may be used in this way in existing shower installations in the home and also in the open.

In a further refinement of the concept of the invention, the drive element consists of a first return roller arranged at the upper end of the guide strut, and an endless cable or the like, the endless cable passing round the return rollers and being connected to the spray tube and preferably the second return roller being free running while the first return roller is connected to the drive means.

The particular advantage of this embodiment lies in the fact that the spray tube is moved in a simple and safe fashion.

Thus, no damage occurs even if the spray tube should be forcibly restrained or pulled back, since all that happens in this case is that the endless cable slips on the return rollers and afterwards resumes its proper movement.

To improve the transmission of power from the first return roller to the endless cable, the first return roller is provided with a friction covering and the second return roller is arranged in a mounting and its distance from the first return roller is adjustable.

In order that the range of action of the spray tube can be altered in a particularly simple fashion, in accordance with a further proposal the switch is arranged in the vicinity of the endless cable and an engagement member is designed to act as an abutment having a bore to receive the endless cable, a locking screw for clamping it to the endless cable, and longitudinal slots to provide guidance in the guide strut.

The apparatus according to the invention is particularly simple to fit up and maintain if, in accordance with a further proposal, a spindle is used as the drive element.

In order that the range of action of the spray tube can easily be altered, the switch has an actuating rod which extends along a line parallel to the guide strut and which carries engagement members, a further engagement member being mounted preferably on the slider and coming alternately into contact with the other engagement members.

In accordance with a further proposal, the spindle for moving the spray tube up and down is connected by a transmission means to a second spindle having a considerably finer thread which is arranged in the vicinity of the switch and which carries a threaded part which is moveable in the longitudinal direction to operate the switch.

A particularly compact design is possible if the spindle has at its upper end a section having a considerably finer thread which carries a threaded part which is moveable in the longitudinal direction to operate the switch.

The engagement members are usefully arranged on the threaded part and are adjustable in the longitudinal direction.

In accordance with another proposal, the switch has an actuating rod which extends along a line parallel to the second spindle or the more finely threaded section and which carries the engagement members and the threaded part has a further engagement member which makes contact alternately with the other engagement members.

Advantageously, at least one engagement member is adjustable on the actuating rod.

In a further refinement of the concept of the invention, the slider has a mounting in which the spray tube is held in such a way as to be displaceable in the direction of its longitudinal axis and in such a way that it can be turned to adjust the angle at which it is set.

BRIEF DESCRIPTION OF THE DRAWINGS

In order that the invention may be more clearly understood, reference will now be made to the accompanying drawings which show presently preferred embodiments thereof by way of example and in which.

DETAILED DESCRIPTION OF PREFERRED EMBODIMENTS

Figure 1:
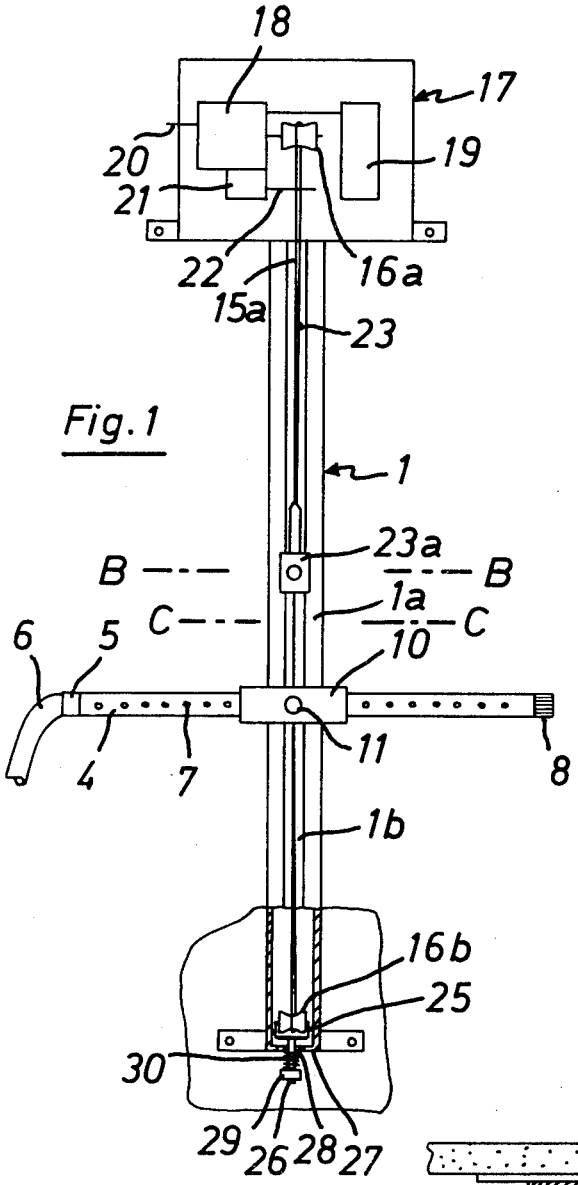
FIG. 1 is a front view, partly cut away, of a first embodiment of apparatus.
Figure 2:
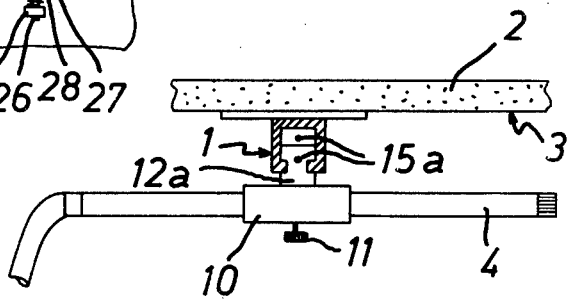
FIG. 2 is a cross-section of this apparatus taken along line B—B of FIG. 1.

Referring now to the drawings, the apparatus shown in FIGS. 1 and 2 consists of a guide strut 1 which is fitted vertically to a wall 2 of a shower cabinet 3. Connected to the guide strut is an elongated spray tube 4 which is orientated transversely to the guide strut 1. By means of a connector 5 at one of its ends the spray tube 4 is connected to a flexible water-supply pipe 6. In operation, water emerges from the spray tube 4 in powerful jets directed in approximately the same direction through nozzles 7 which are arranged in a longitudinal line. The unconnected end of the spray tube 4 is also formed as a connector 5 but is closed off by a plug 8.

In its central region the spray tube 4 is held by a mounting 10 having a locking screw 11. The mounting 10 encloses the spray tube 4 and when the locking screw 11 is released it allows the spray tube 4 to be moved in the direction of its longitudinal axis and to be turned about its longitudinal axis to allow the angle at which its nozzles 7 are set to be adjusted. In addition, it is also possible for the spray tube 4 as a whole to be exchanged for another tube having larger or smaller nozzles or more or fewer nozzles, etc.

The guide strut 1 is a tube 1*a* containing a longitudinal slot 1*b*. In the longitudinal slot 1*b*, a slider 12*a* provided with guide slots is held so as to be sure secure against the rotation and is able to move up and down.

The slider 12*a* is connected on the one hand to the mounting 10 and on the other hand to an endless cable 15*a* which passes over a first return roller 16*a* at the upper end of the guide strut 1 and a second return roller 16*b* at the lower end of the guide strut 1. The first return roller 16*a* is located in a housing 17 which is arranged at the upper end of the guide strut 1 and which in the present case is shown without its front cover.

Whereas the second return roller 16*b* is free to rotate, the first return roller 16*a* has a drive means 18 in the form of an electric motor which is fed by a low-voltage battery 19 and which can be started by an on/off switch 20 and whose direction of rotation can be reversed by a switch 21 in the form of a polarity-changing switch. The first return roller 16*a* is provided with a friction covering to enable it better to apply traction to the endless cable 16*a*.

The drive means 18, together with low-voltage battery 19, the on/off switch 20 and the switch 21 are also arranged in the housing 17, the on/off switch 20 being accessible or operable from outside. The switch 21 has an arm 22 which is provided with a bore through which the endless cable 15*a* is provided with two engagement members 23 and 23*a* which are unable to pass through the bore and which instead move the arm 22, as a result of which the direction of rotation is reversed. In the present embodiment the engagement member 23 is a knot in the endless cable 15*a*.

Figure 3:
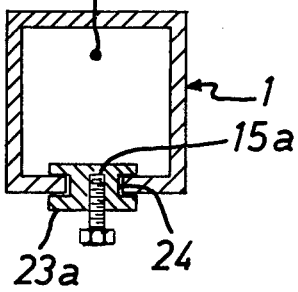
FIG. 3 is an enlarged section through the guide strut shown in FIG. 1, on line C—C.

As can more clearly be seen in FIG. 3, the engagement member 23*a* is in the form of an adjustable abutment having a bore to receive the endless cable 15*a*, a locking screw to clamp it to the endless cable 15*a*, and longitudinal slots 24 to guide it in the guide strut 1, that is to say in the longitudinal slot 1*b* of the latter. By means of this engagement member, it is possible without difficulty to alter the range over which the spray tube 4 moves continuously up and down.

It can also be seen from FIG. 1 that the second return roller 16*b* is arranged in a U-shaped mounting 25. This mounting is held in a blanking plate 27 at the lower end of the guide strut 1 by means of a threaded shank 26. The threaded shank 26 passes through a bore 28 in the blanking plate 27 and carries a nut 29. Between the nut 29 and the blanking plate 27 is arranged a compression spring 30. The bore 28 in the blanking plate 27 is sufficiently large for the threaded shank 26 to be able to move freely in the longitudinal direction of the guide strut 1. The compression spring 30 however attempts to press the threaded shank 26 outwards, which places the endless cable 15*a* under tensile stress. The tensile stress can easily be altered by adjusting the nut 29.

Figure 4:
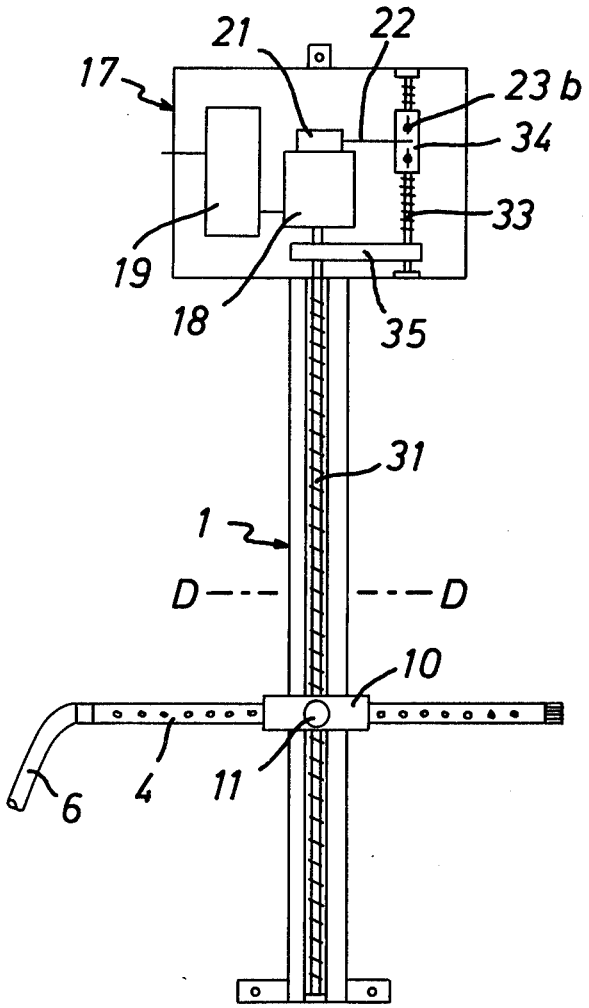
FIG. 4 is a front view, partially cut away, of a second embodiment of apparatus.
Figure 5:
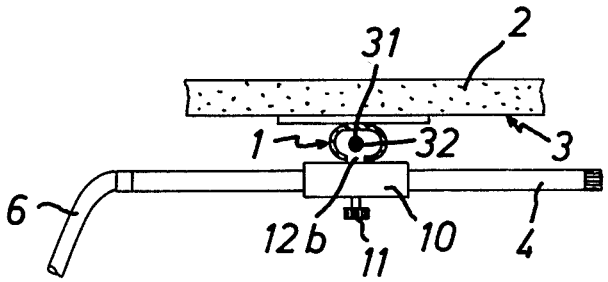
FIG. 5 is a section through the subject of FIG. 4 on line D—D.

FIGS. 4 and 5 show a structure which is largely similar but in this case the up and down movement of the spray tube 4 is brought about by means of a spindle 31 which is arranged in the guide strut 1 and which cooperates with a slider 12*b* which is guided inside the guide strut 1 in such a way as to be secure against rotation and which has a bore 32 having an internal thread matched to the external thread on the spindle 31. The slider 12*b* is connected to the mounting 10 and with each rotation of the spindle 31 is moved further up or down. In the vicinity of the switch 21 is arranged a second spindle 33 which is sufficiently small to be completely accommodated in the housing 17. The second spindle 33 carries a threaded part 34 which is moveable in the longitudinal direction and it is connected by a transmission device 35 to the first spindle 31. The transmission device 35 is so designed that the second spindle 33 turns more slowly than the first spindle 31. In addition, the second spindle 33 has a finer thread than the first spindle 31 and as a result the threaded part 34 moves for considerably shorter distances than the spray tube 4.

The threaded part 34 is provided with engagement members 23*b* which are able to operate the switch 21 via its arm 22. The engagement members 23*b* are adjustable in the longitudinal direction of the second spindle 23, the members passing through the housing 17 and being accessible from the exterior. In this way the range of action of the spray tube is once again easily able to be altered both as regards the distance from one point of reversal to the other and also as regards height.

Figure 6:
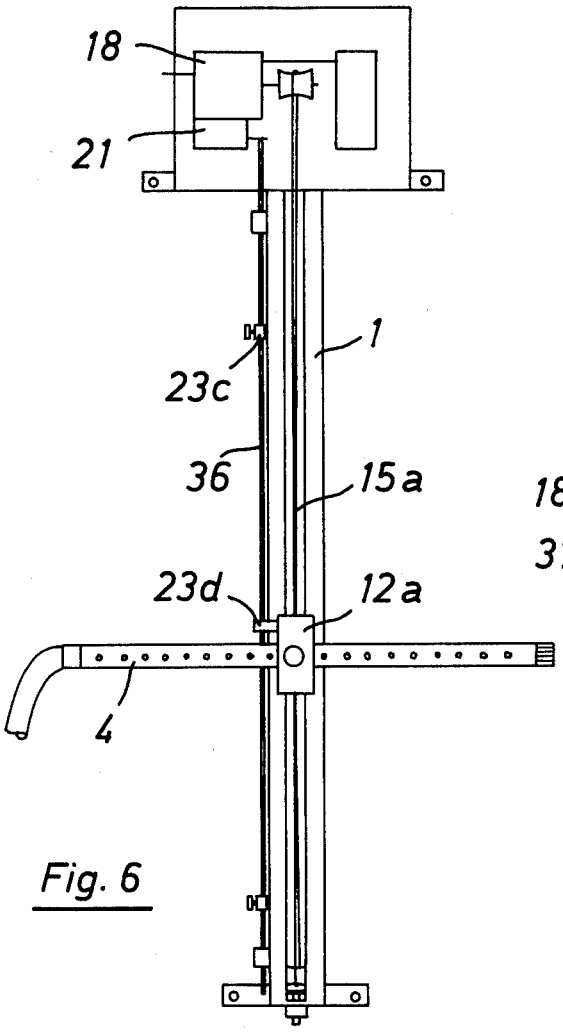
FIG. 6 is a front view, partly cut away, of a third embodiment.

The drive element in FIG. 6 for the spray tube is once again an endless cable 15*a*. In contrast to FIG. 1, in the present case the switch 21 has an actuating rod 36 which extends along a line parallel to the guide strut 1 and which is loosely mounted. The actuating rod 36 carries two adjustable engagement members 23*c* while the slider 12*a* has one further engagement member 23*d*.

When the drive means 18 is switched on, the engagement member 23*d* comes alternately into contact with the engagement members 23*c*, as a result of which there is a continual reversal of the direction of rotation of the drive means. This method of control is not dependant on the nature of the drive element. The drive element could equally well be a spindle or a piston and cylinder arrangement or the like.

Figure 7:
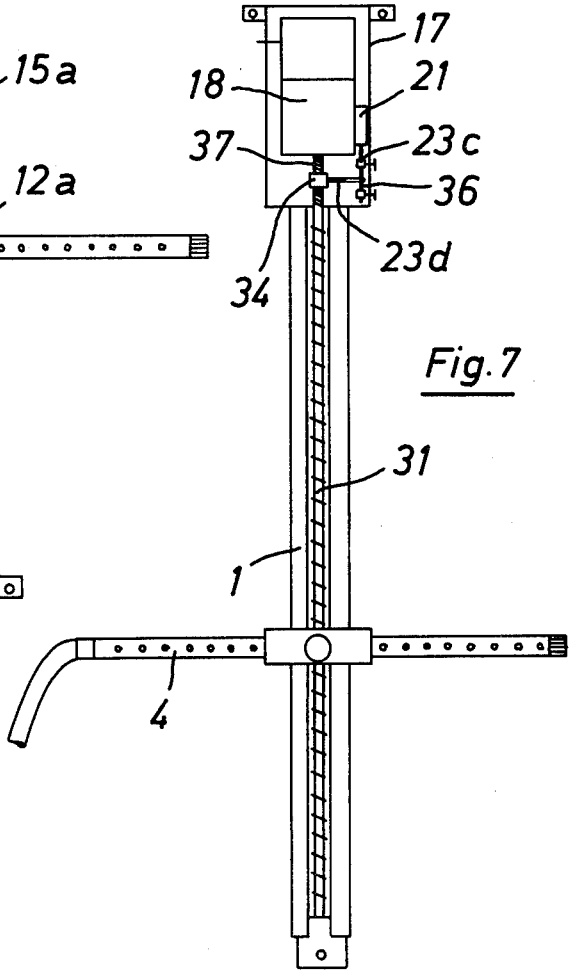
FIG. 7 is a front view, also partly cut away, of a further embodiment.

FIG. 7 shows a further preferred embodiment of the invention. In this case, the spindle 31 extends directly into a threaded section 37 having a considerably finer thread and is connected to the drive means 18. The threaded section 37 carries a threaded part 34 carrying an engagement member 23*d*.

The threaded part 34 moves simultaneously with the spray tube 4 but for a considerably shorter distance. The switch 21 once again has an actuating rod 36 but in this case the rod extends only along the threaded section 37. On the actuating rod 36 are once again arranged two engagement members 23*c*. These pass through the housing 17 and are adjustable. By means of them the range over which the spray tube 4 is to perform a continuous up and down movement may be adjusted in a particularly simple fashion.

I claim:

1. Apparatus for making use of water for health care, comprising:
   - a guide strut arranged for vertical attachment to a support means;
   - a slider cooperating with said guide strut;
   - a spray tube means connected to said slider;
   - a connector on said spray tube means for a flexible water-supply pipe;
   - a threaded drive spindle associated with said guide strut, said drive spindle being arranged to effect up and down movement of said spray tube;
   - said drive spindle having a reversably rotatable drive means;
   - two spaced engagement members supported externally of said drive means; and
   - said drive means including a switch which serves to reverse the direction of rotation of said drive means, said switch being actuable by said two spaced engagement members;
   - at its upper end, said threaded drive spindle having a section which has a considerably finer thread than that of said spindle proper, a threaded part, threadedly mounted on said section for respective-direction longitudinal movement upon rotation of said spindle, said threaded part having means for alternately engaging said two spaced engagment members for operating said switch.

2. Apparatus according to claim 1, wherein said switch has an actuating rod which carries said two spaced engagement members.

3. Apparatus according to claim 2, wherein at least one said engagement member is adjustable on said actuating rod.

* * * * *